US007748863B1

(12) United States Patent
Holman et al.

(10) Patent No.: US 7,748,863 B1
(45) Date of Patent: Jul. 6, 2010

(54) SOLAR LIGHT APPARATUS AND SYSTEM

(75) Inventors: Jeffrey T. Holman, 3538 Mendenhall Ct., Pleasanton, CA (US) 94588; W. Shane Willard, Kaysville, UT (US)

(73) Assignee: Jeffrey T. Holman, Farmington, UT (US)

( * ) Notice: Subject to any disclaimer, the term of this patent is extended or adjusted under 35 U.S.C. 154(b) by 153 days.

(21) Appl. No.: 11/514,760

(22) Filed: Sep. 1, 2006

Related U.S. Application Data

(60) Provisional application No. 60/713,795, filed on Sep. 1, 2005.

(51) Int. Cl.
*F21L 13/00* (2006.01)

(52) U.S. Cl. ..... 362/183; 362/431; 362/559

(58) Field of Classification Search ..... 362/190, 362/191, 192, 227, 249, 362, 363, 367, 368, 362/812, 183, 431, 559; 40/541, 564, 584, 40/606.01, 607.01, 617
See application file for complete search history.

(56) References Cited

U.S. PATENT DOCUMENTS

| | | | | |
|---|---|---|---|---|
| 3,952,978 | A * | 4/1976 | Reinitz | 246/477 |
| 4,005,537 | A | 2/1977 | Von Camber et al. | |
| 4,087,785 | A * | 5/1978 | Dodich | 340/908.1 |
| 4,299,043 | A | 11/1981 | Lathrop et al. | |
| 4,319,310 | A | 3/1982 | Kingsley | |
| 4,718,185 | A | 1/1988 | Conlin et al. | |
| 4,843,525 | A | 6/1989 | Williams | |
| 5,101,329 | A * | 3/1992 | Doyle | 362/183 |
| 5,467,076 | A * | 11/1995 | Ruocco et al. | 340/571 |
| D378,143 | S | 2/1997 | Kollins | |
| D379,545 | S | 5/1997 | Houghton et al. | |
| 5,729,924 | A * | 3/1998 | Reading | 40/564 |
| 6,004,002 | A * | 12/1999 | Giannone | 362/183 |
| 6,263,601 | B1 | 7/2001 | Emert | |
| 6,604,840 | B2 | 8/2003 | Watson | |
| 7,654,684 | B1 * | 2/2010 | Wight et al. | 362/183 |
| 2004/0177538 | A1 | 9/2004 | De Ruyter et al. | |
| 2006/0050528 | A1 * | 3/2006 | Lyons et al. | 362/559 |
| 2006/0164827 | A1 * | 7/2006 | Minewiser et al. | 362/183 |
| 2006/0185203 | A1 * | 8/2006 | Bittle et al. | 40/541 |
| 2006/0260160 | A1 * | 11/2006 | Herman | 40/540 |
| 2006/0274521 | A1 * | 12/2006 | Ullrich | 362/159 |
| 2007/0230166 | A1 * | 10/2007 | Gelbert | 362/145 |

FOREIGN PATENT DOCUMENTS

| | | |
|---|---|---|
| CA | 2209867 | 2/1999 |

* cited by examiner

*Primary Examiner*—Douglas W Owens
*Assistant Examiner*—Tung X Le
(74) *Attorney, Agent, or Firm*—Jeffrey T. Holman

(57) ABSTRACT

A sign light to illuminate a sign such as a real estate sale sign. The sign light is configured to suspend between the crossarm of a sign post and the sign. The sign light includes a housing, a light source, and sign mounting hardware. The housing allows the sign light to suspend from a crossarm of a sign post. The housing includes an internal compartment. The light source is located within the internal compartment of the housing. The sign mounting hardware is directly coupled to the housing to provide a mounting location for a sign to hang from the mounting hardware. The housing and mounting hardware facilitate suspending the sign light between the crossarm of the sign post and the sign.

19 Claims, 21 Drawing Sheets

SOLAR LIGHT APPARATUS AND SYSTEM

RELATED APPLICATIONS

This application claims the benefit of priority of U.S. Provisional Patent Application 60/713,795 entitled "Solar Light Apparatus and System," filed Sep. 1, 2005.

TECHNICAL FIELD

This application relates to lighting and, in particular, relates to solar lighting for signs.

BACKGROUND

Solar lighting for signs is becoming more and more popular. One area of particular interest concerns real estate signs such as "For Sale" signs. While many products are becoming available, most of these products are awkward and detract from the professional nature of the real estate signs.

Some conventional solar lighting products for real estate signs attach directly to the sign itself. Some real estate professionals have expressed concern that the solar lighting products will mark up or otherwise deteriorate the physical features of the signs. Others are concerned that such solar lighting products will obstruct the view of potential clients or buyers. There are also concerns that such sign-mounted solar lighting products simply make the sign appear unprofessional.

Some other conventional solar lighting products are surface mounted on a sign post. There are similar concerns with these products because they are typically mounted in a manner that either places them on top of a sign post cross-arm and, hence, a significant distance from the sign, or extend outward from the sign post and, hence, inviting vandalism and theft. Additionally, conventional solar lighting products which are surface mounted on a sign post typically look unprofessional.

BRIEF DESCRIPTION OF THE DRAWINGS

Embodiments of the present invention are illustrated by the following exemplary drawings, which are not to be considered limiting of the scope of the present invention.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
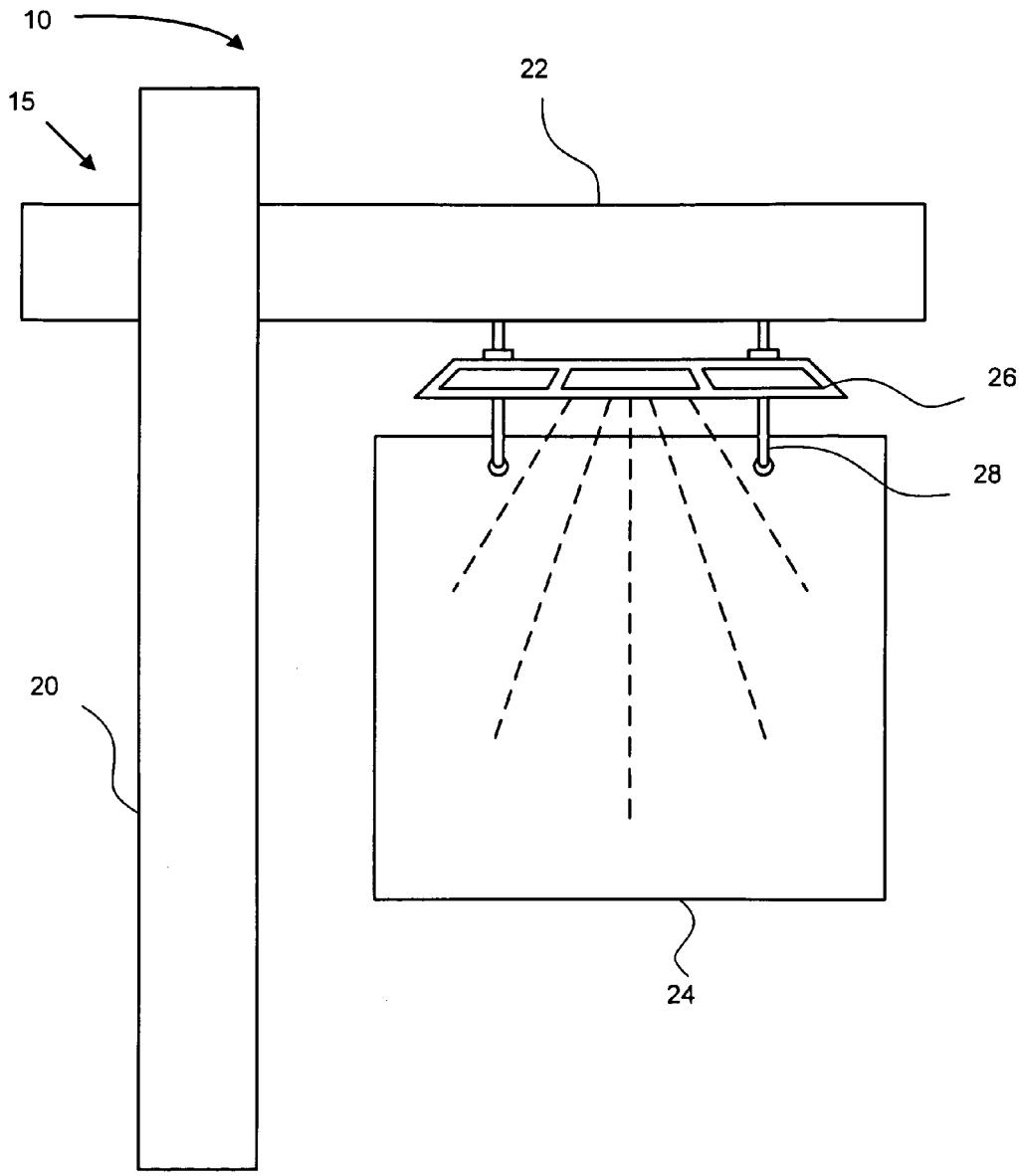
FIG. 1 is a schematic diagram illustrating one embodiment of a lighting system.

FIG. 1 depicts one embodiment of a lighting system 10. The lighting system 10 includes a sign post 15 having a vertical member 20 and a crossarm 22. for convenience, the term "sign post" may be used to refer to the vertical member alone 20 or the combination of the vertical member 20 and the crossarm 22 together. The sign post 15 may be any type of sign post, such as wood, aluminum (or another metal), plastic (e.g., PVC), or another material. Many conventional types of sign posts 15 of various sizes are known in the art.

The sign post is configured to display a sign 24. In one embodiment, the sign 24 may hang from the crossarm 22 of the sign post 15. Alternatively, the sign 24 may be attached to the sign post 22 in another manner.

A lighting apparatus 26 is mounted between the crossarm 22 and the sign 24 to illuminate the sign 24. Various embodiments of the lighting apparatus 26 are shown and described herein. In general, embodiments of the lighting apparatus 26 may include solar panels to energize lights using solar power. Alternatively, the lighting apparatus 26 may use battery power without solar panels. In another embodiment, power for the lighting apparatus 26 may be supplied in another manner, such as fuel cells, a cord and plug, or another power source. In general, the lighting apparatus 12 is configured to illuminate one or both faces of the sign 14. In some embodiments, the lighting apparatus 26 is particularly suited to illuminate a real estate sign 24 that is approximately 2' by 1.5° or 2' by 2' having a rectangular shape that may or may not be square. Although certain embodiments of the lighting apparatus 12 may be configured with a lighting distribution pattern optimized for a sign 24 of between one and three feet in height and/or width, other embodiments of the lighting apparatus 26 may adequately illuminate a sign 24 of larger or smaller dimensions in height and/or width. Several non-exclusive examples of the lighting apparatus 26 are provided and described in more detail with reference to the following figures.

In one embodiment, the lighting apparatus 26 is secured to the crossarm 22 in a movable fashion so that the lighting apparatus 26 may move somewhat independently of the crossarm 22. For example, the lighting apparatus 26 may be fastened to the crossarm 22 by a hook, a ring, or another fastener 28 which permits some movement of the lighting apparatus 26. In one embodiment, allowing movement between the lighting apparatus 26 and the crossarm 22, as well as between the lighting apparatus 26 and the sign 24, provides a dampening effect on movement of the sign 24 due to other forces such as wind, etc. In this way, the sign may maintain a more steady position than it otherwise might. Alternatively, the lighting apparatus 26 may be fastened to the crossarm 22 or the sign 24 or both in a more rigid manner. For example, the lighting apparatus may be fastened to the crossarm 22 using screws, adhesive, clamps, or another type of rigid fastener.

Figure 2:
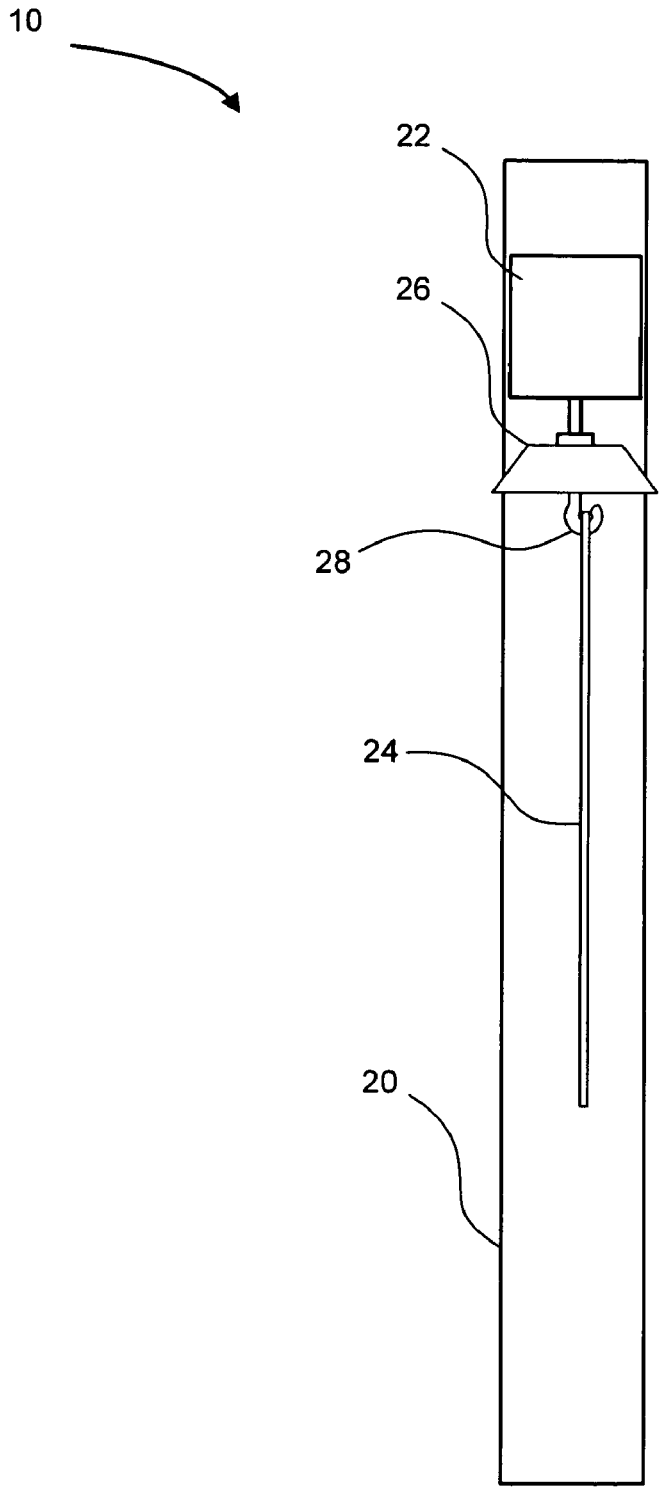
FIG. 2 is a schematic diagram illustrating another view of the lighting system of FIG. 1.

FIG. 2 is a schematic diagram illustrating another view of the lighting system of FIG. 1. In one embodiment, the lighting apparatus 26 may extend beyond the dimensions of the crossarm 22. Extending at least a portion of the lighting apparatus 26 past the dimensions of the crossarm 22 may facilitate receiving sunlight on one or more solar panels of the lighting apparatus. Alternatively, embodiments of the lighting apparatus 26 may be narrower than the dimensions of the crossarm 22 and/or post 20.

Figure 3:
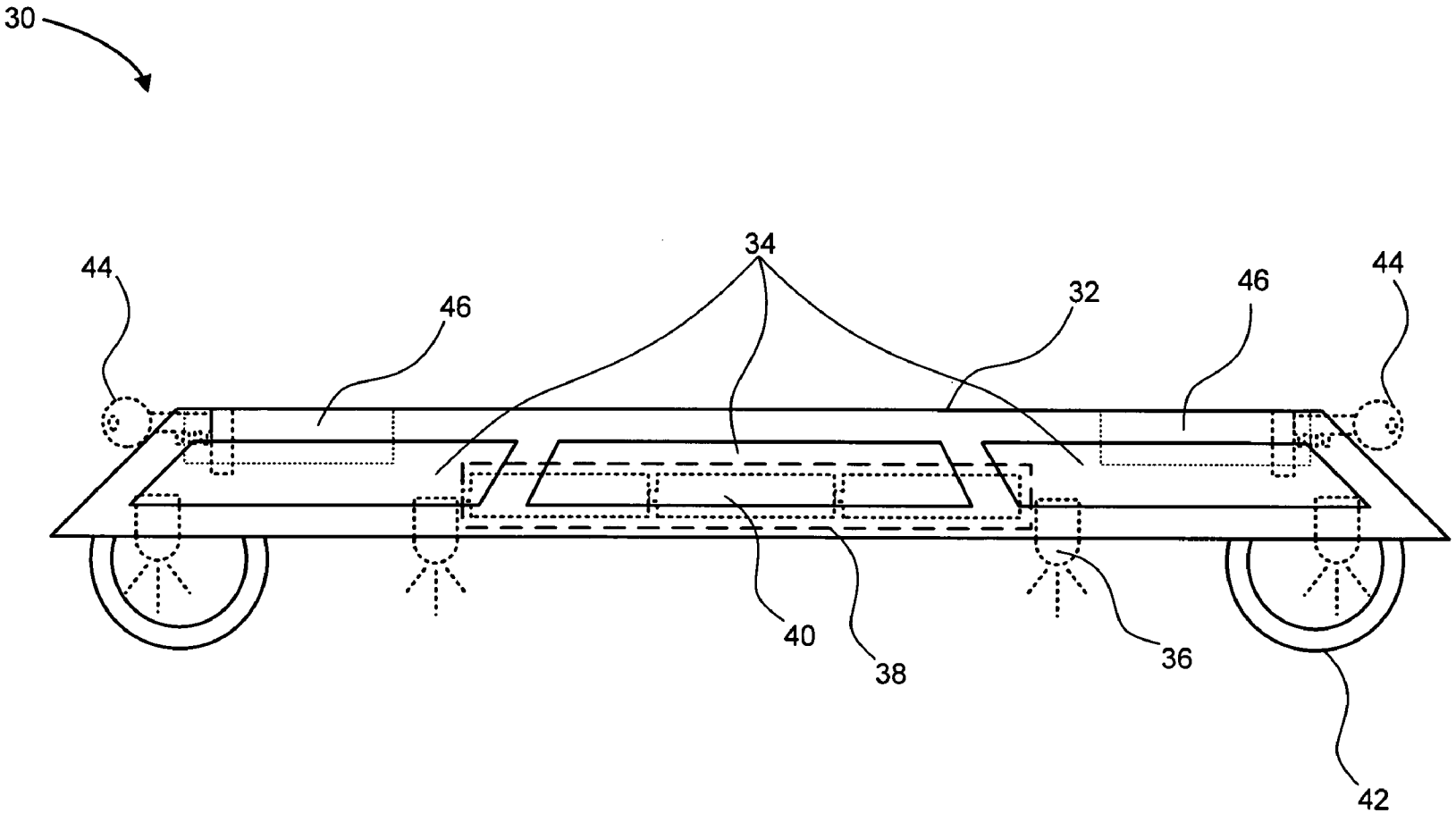
FIG. 3 is a schematic diagram illustrating a cross-sectional view of one embodiment of the lighting apparatus of FIGS. 1 and 2.

FIG. 3 is a schematic diagram illustrating a cross-sectional view of one embodiment of the lighting apparatus 30 of FIGS. 1 and 2. In the depicted embodiment, the lighting apparatus includes a housing 32, one or more solar panels 34, and one or more light sources 36. Additionally, the lighting apparatus 30 may include a battery compartment 38, batteries 40, sign mounting devices 42, and one or more locking mechanisms 44.

In one embodiment, the housing 32 defines an inner cavity. The housing 32 may be manufactured of plastic, metal, or another substantially rigid material that is suitable for exterior use and exposure to the natural elements.

The solar panels 34 may be integrated into the housing 22 during the manufacture of the lighting apparatus 26 or subsequently installed. The solar panel 34 may be a standard solar panel known currently within the art. Where multiple solar panels 34 are included, the separate solar panels 34 may be electrically connected together in any circuitry configuration as may be appropriate for collecting the solar energy and transferring that energy to the battery 40 and/or electrical load such as the light sources 36. The lighting apparatus 26 also may include a photocell (not shown), timer (not shown), or other type of switch for switching the electrical power or control circuit. In another embodiment, the lighting apparatus 26 may be controlled by other control circuitry. For example, in one embodiment, the solar panel 26 may control the circuit by directing solar energy to the battery 40 when sufficient solar energy is collected by the solar panel 34, and allowing the solar panel 34 to disconnect itself upon the absence of sufficient solar energy, thereby allowing a normally closed switch to close and connect a load to the battery 40.

In one embodiment, the battery compartment 38 may be equipped with certain wires or other components to allow multiple batteries to be connected in series or parallel configurations. In one embodiment, the battery compartment 40 is configured to hold three rechargeable batteries of the standard AA size and to connect such in series. In another embodiment, the battery compartment 40 may be configured to hold fewer or more batteries of the same or different types or sizes.

In one embodiment, the light source 36 is located within the inner cavity of the housing 32. The light source 36 may be oriented in any manner that provides a suitable light distribution pattern for the sign 24. In one embodiment, the light source 36 is configured to provide a predetermined light distribution pattern that is adequate to illuminate a variety of signs 24. The light source 36 may be any type of light source that produces enough light to illuminate the sign 24 at night. Daylight illumination may be unnecessary, although certain embodiments may be configured to provide such. In one embodiment, the light source 36 includes one or more light emitting diodes (LEDs). In other embodiments, the light source 36 may be another type of light source 36, including fluorescent, low-voltage, xenon, incandescent, and so forth. For convenience, the following references to a specific type of light source 36 such as LEDs is understood to refer to a generic light source 36, unless stated otherwise explicitly or within the context of the description. The LEDs 36 together may emit one or more colors, including, but not limited to, white, amber, blue, green, red, and so forth. One embodiment of the light source 36 includes three super bright white LEDs 36. The LEDs 36 may be coupled to a single connection or may be connect through one or more other circuit components.

Additionally, the LEDs 36 may be independently oriented to illuminate a particular section of the sign 24 so that, together, the LEDs 36 adequately illuminate the face of the sign 24. Furthermore, the orientation of each of the LEDs may depend on the designed location of the lighting apparatus 30 when mounted relative to the sign 24.

In one embodiment, the locking mechanisms 44 are configured to allow at least one locking location to lock the lighting apparatus 30 to the sign post 15 and or the sign 24. Exemplary locking mechanisms include a keyed lock, a keyed padlock, a tumbler lock, a cable lock, or another type of locking device. In some embodiments, the locking mechanism 44 may be at least partially movable within a space 46 to allow the locking mechanism to be moved to accommodate a mounting width of the sign post 15. Similarly, the mounting rings 42 may be movable to accommodate various sign widths.

Figure 4:
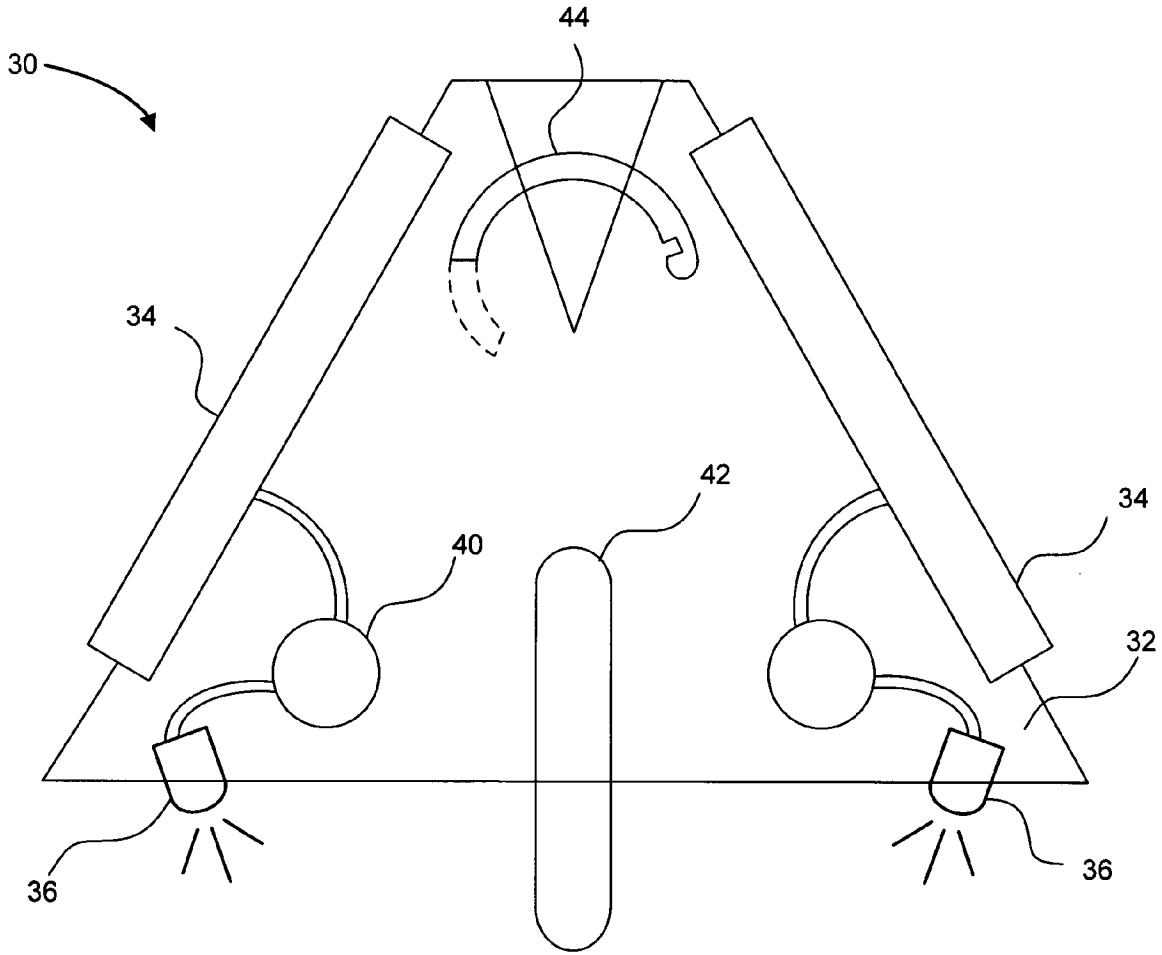
FIG. 4 is a schematic diagram illustrating another cross-sectional view of one embodiment of the lighting apparatus of FIG. 3.

FIG. 4 is a schematic diagram illustrating another cross-sectional view of one embodiment of the lighting apparatus 30 of FIG. 3. The various components of the lighting apparatus 26 are identified and described with reference to FIG. 3. FIG. 4 also shows one embodiment of the locking mechanism 44 in which a bar or ring may be moved from an unlocked position (shown dashed) to a locked position. Other types of locking mechanisms 44 may be used.

Figure 5:
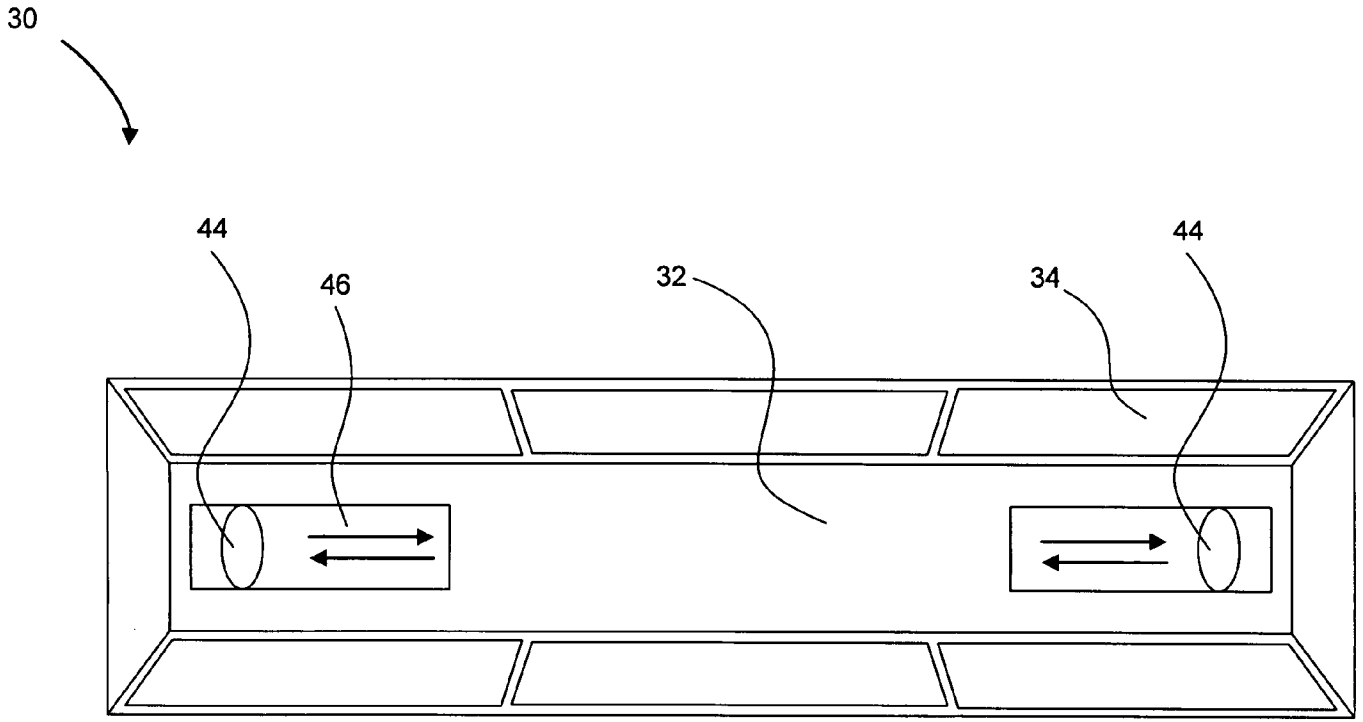
FIG. 5 is a schematic diagram illustrating a top view of another embodiment of the lighting apparatus of FIG. 3.

FIG. 5 is a schematic diagram illustrating a top view of another embodiment of the lighting apparatus 30 of FIG. 3. The depicted embodiment illustrates the spaces 46 which accommodate movement of the locking mechanisms 44. A more detailed embodiment of movable locking mechanisms 44 is illustrated and described with reference to other figures.

Figure 6:
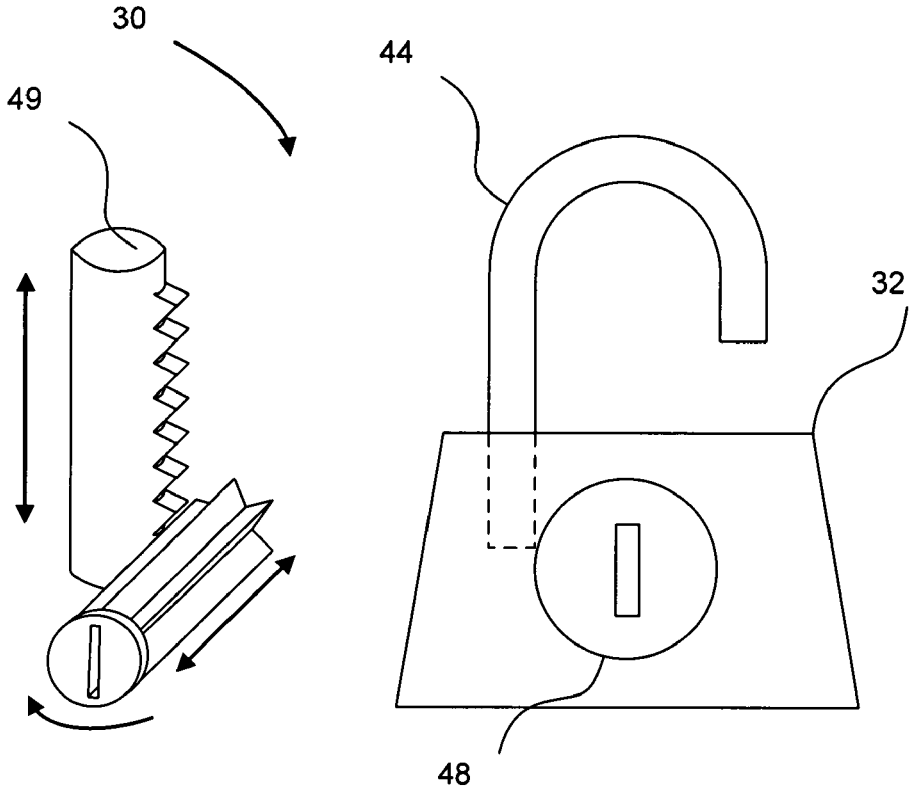
FIG. 6 is a schematic diagram illustrating one embodiment of a locking mechanism, in an unlocked position, for a lighting apparatus such as the lighting apparatus of FIG. 3.

FIG. 6 is a schematic diagram illustrating one embodiment of a locking mechanism 44, in an unlocked position, for a lighting apparatus 30 such as the lighting apparatus of FIG. 3. In one embodiment, the locking mechanism 44 includes parts with mechanical teeth which engage with one another to facilitate both sliding engagement along the axis of the keyed portion and rotational engagement upon rotation of the keyed portion (so the vertical portion moves up and down in response to the rotation).

Figure 7:
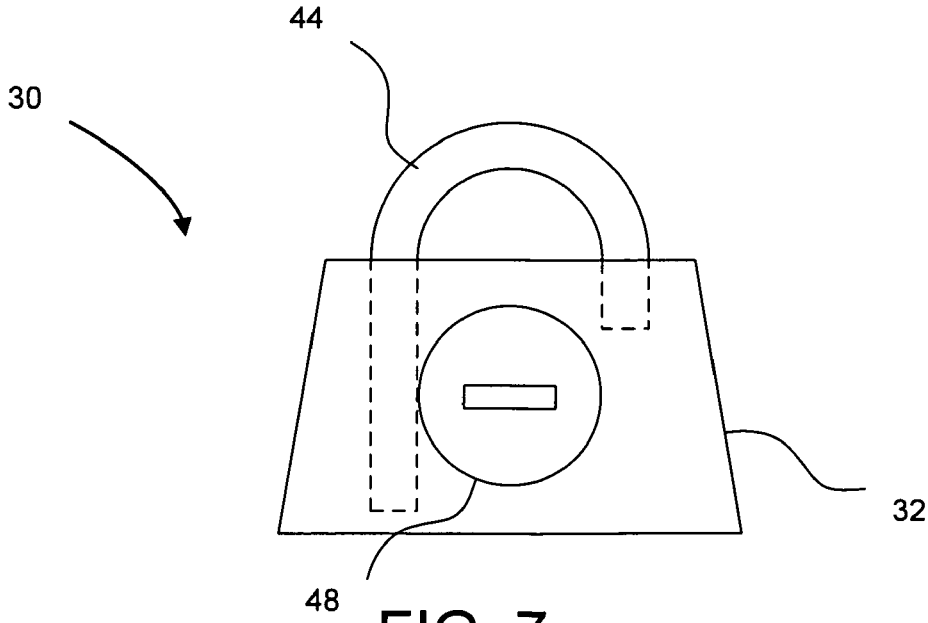
FIG. 7 is a schematic diagram illustrating the locking mechanism, in a locked position, of FIG. 6.

FIG. 7 is a schematic diagram illustrating the locking mechanism 44, in a locked position, of FIG. 6. In this way, the locking mechanism 44 closes around a ring or other fastener 28 coupled to the sign post 15 so that the lighting apparatus 30 is not easily removed from attachment to the sign post. This may prevent or discourage theft of the lighting apparatus 30.

Figure 8:
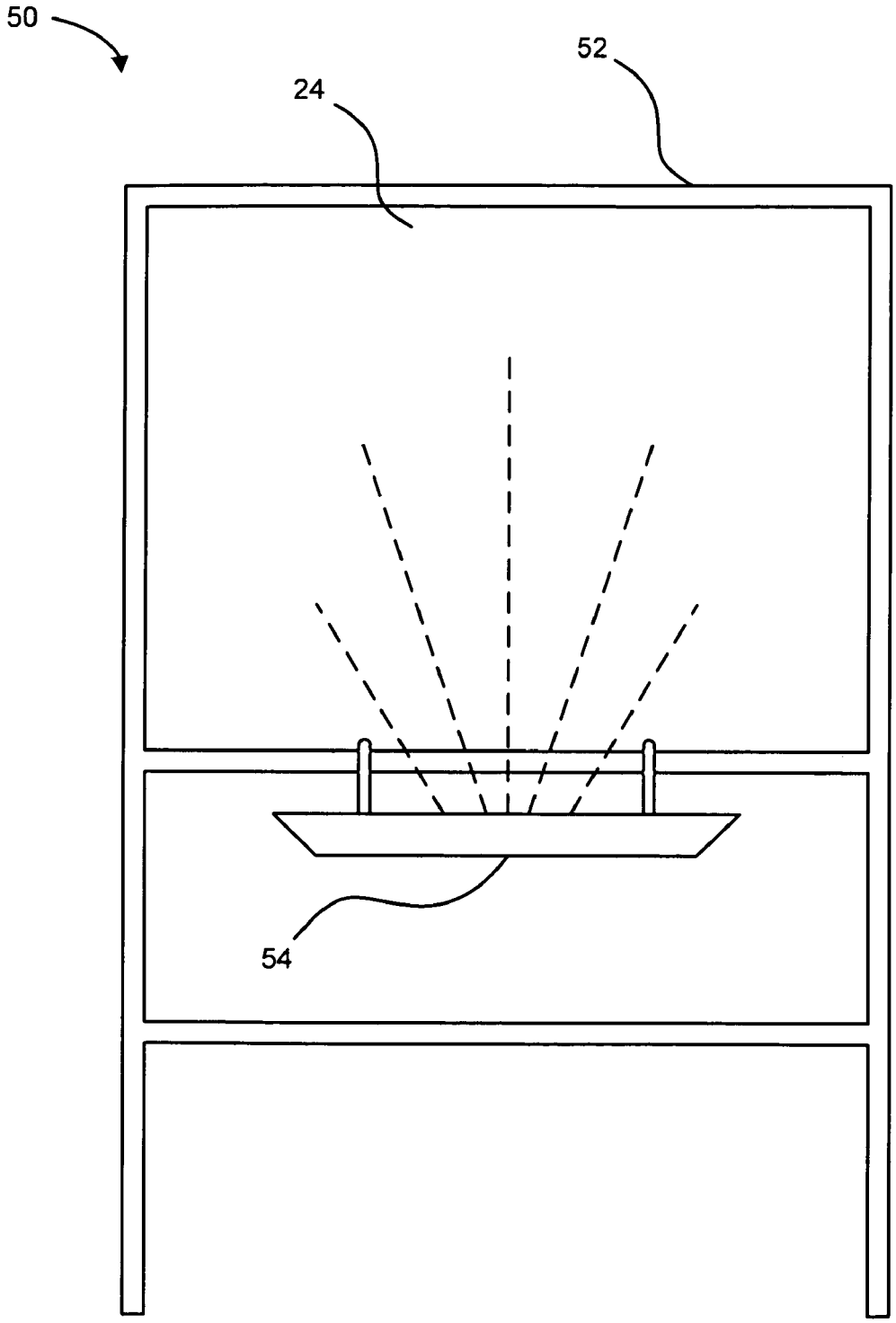
FIG. 8 is a schematic diagram illustrating another embodiment of a lighting apparatus of another lighting system.

FIG. 8 is a schematic diagram illustrating another embodiment of a lighting apparatus 54 of another lighting system 50. The lighting system 50 includes a sign frame 52 (sometimes referred to as an "H" frame or an "A" frame). Many variations of this type of sign frame 52 are prevalent in the real estate industry or other signage applications. In one embodiment, the lighting apparatus 54 is mounted to a crossbar of the sign frame 52. The lighting apparatus 54 may be similar, in some respects to the lighting apparatuses described above, except configured to direct the light upward, instead of downward, toward the sign 24.

Figure 9:
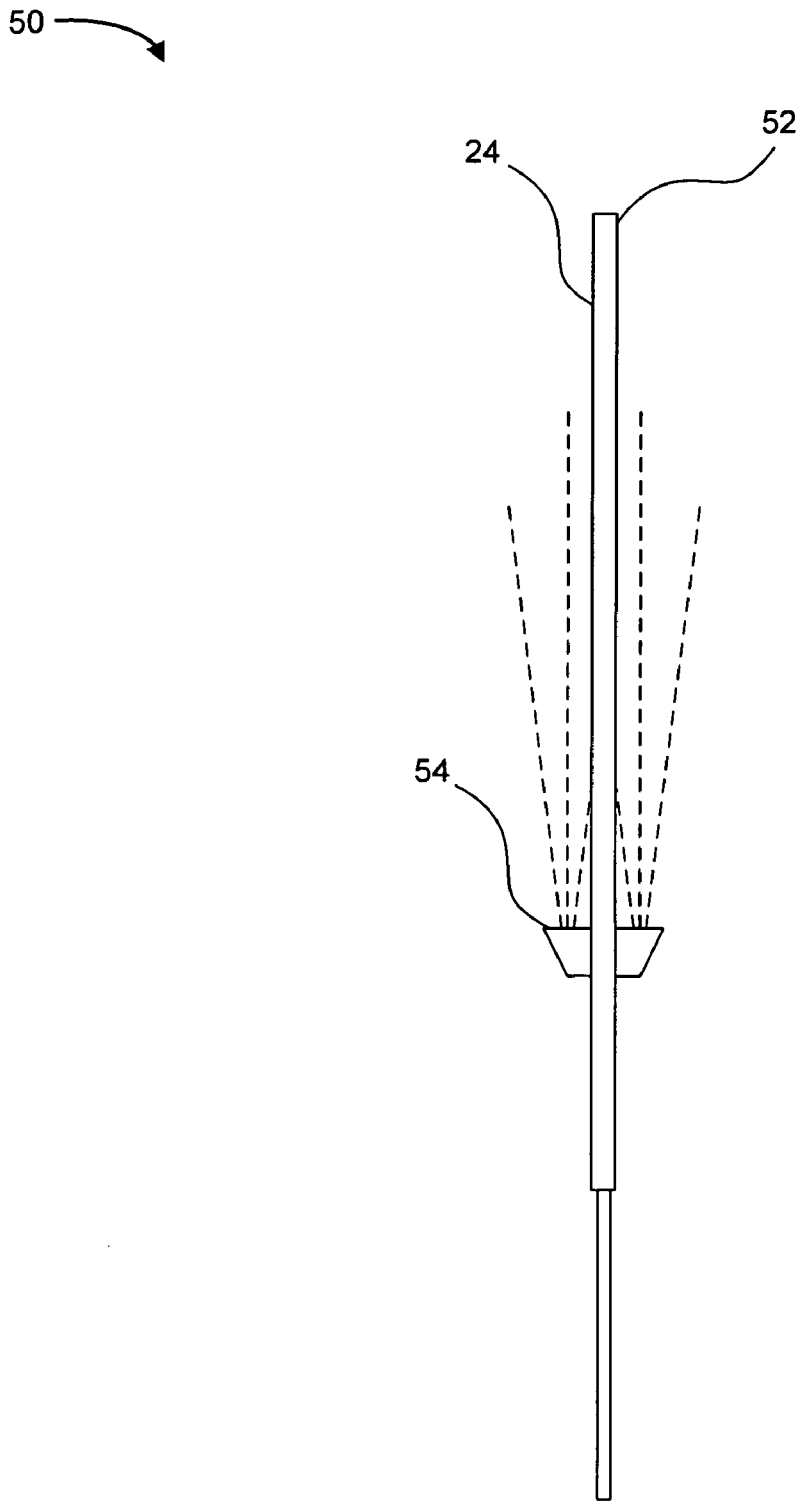
FIG. 9 is a schematic diagram illustrating another view of the lighting apparatus and lighting system of FIG. 8.

FIG. 9 is a schematic diagram illustrating another view of the lighting apparatus 54 and lighting system 50 of FIG. 8. This illustrates that the lighting apparatus 52 may extend past the dimensions of the sign 24 and or sign frame 52.

Figure 10:
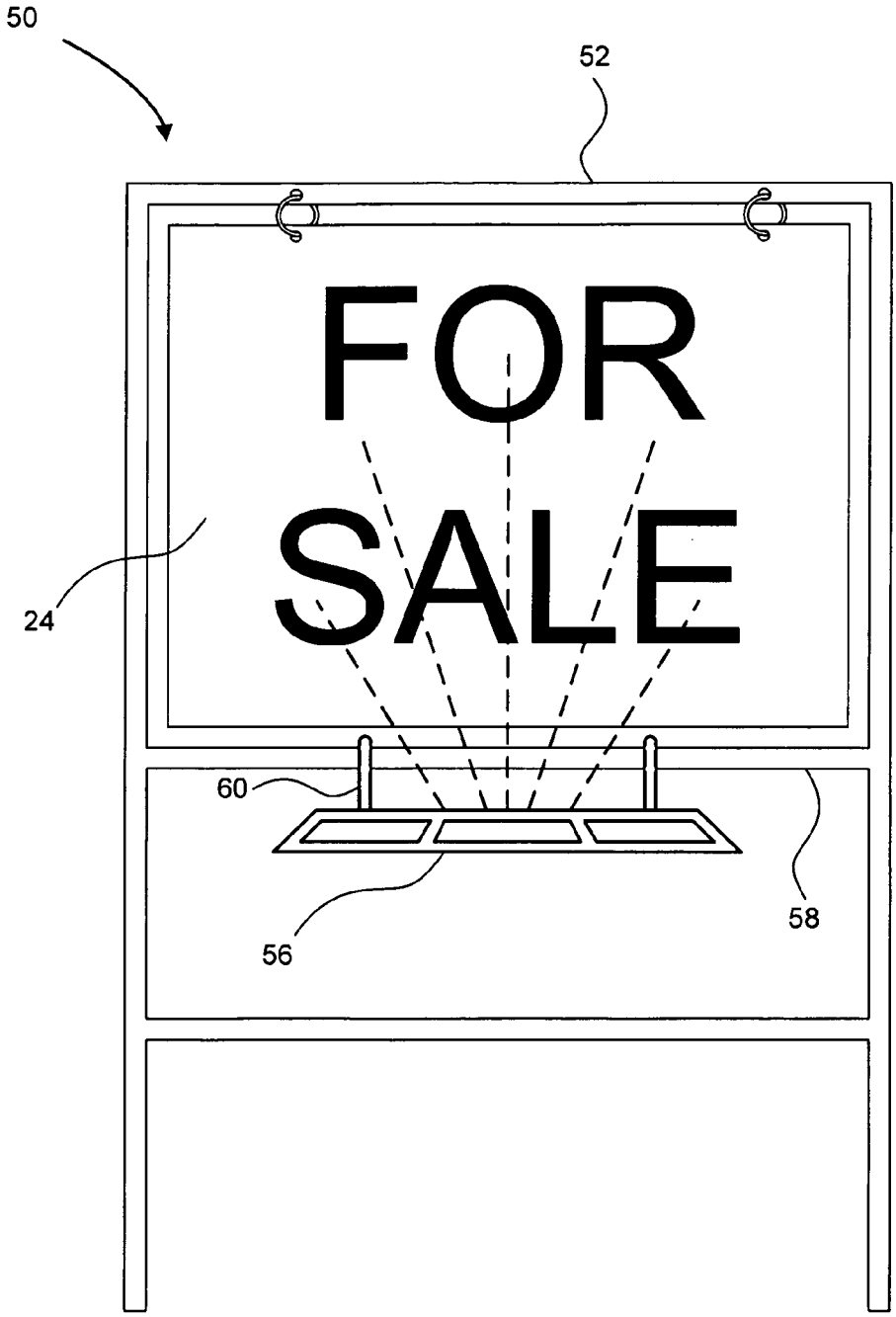
FIG. 10 is a schematic diagram illustrating another embodiment of a lighting apparatus and a lighting system.

FIG. 10 is a schematic diagram illustrating another embodiment of a lighting apparatus 56 and a lighting system 50. This embodiment of the lighting apparatus 56 may be substantially similar to the lighting apparatus 52 of FIGS. 9 and 10. However, some embodiments may implement various housing configurations to facilitate different combinations of solar panels, light sources, and other components of the lighting apparatus 56. For example, the sides of the lighting apparatus 56 are angled downward, instead of upward like the lighting apparatus 52.

Figure 11:
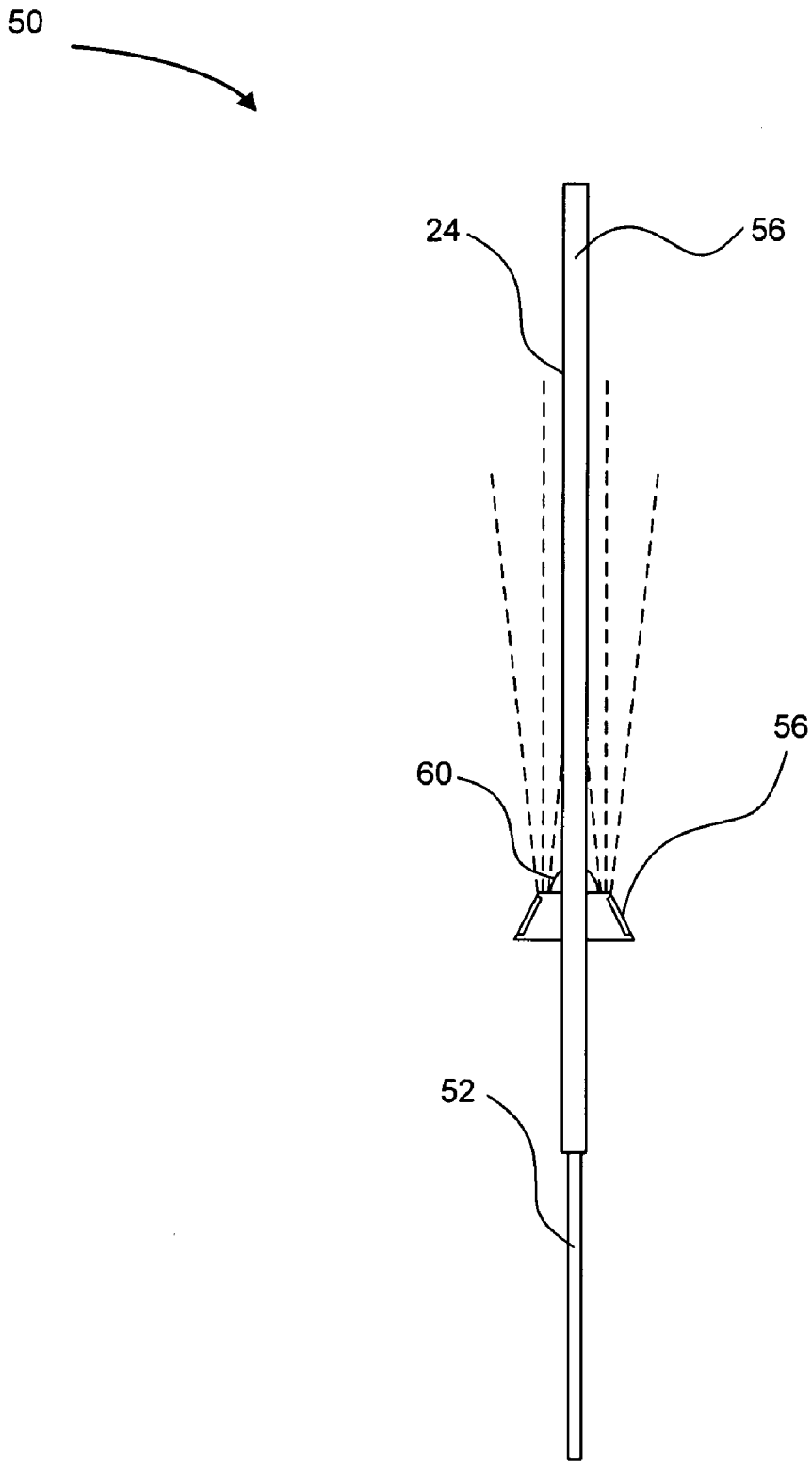
FIG. 11 is a schematic diagram illustrating another view of the lighting apparatus and lighting system of FIG. 10.

FIG. 11 is a schematic diagram illustrating another view of the lighting apparatus 56 and lighting system of FIG. 10.

Figure 12:
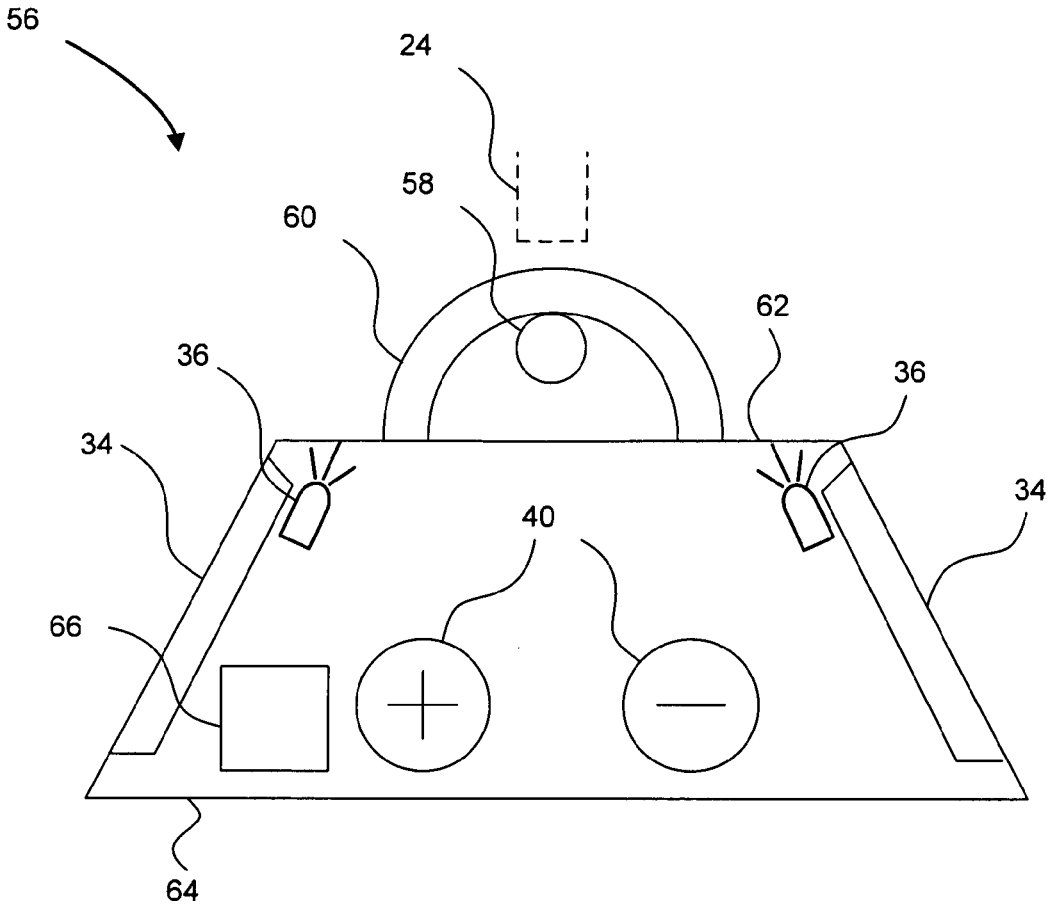
FIG. 12 is a schematic diagram illustrating a cross-sectional view of another embodiment of a lighting apparatus.

FIG. 12 is a schematic diagram illustrating a cross-sectional view of another embodiment of a lighting apparatus 56. In particular, the depicted lighting apparatus 56 includes batteries 40, LEDs 36 (or another light source), solar panels 34, LED circuitry 66 (or equivalent circuitry for other types of light sources), and mounting hardware 60. In one embodiment, the mounting hardware 60 may be integrated into the housing 64 of the lighting apparatus 56, although other embodiments may accommodate separate mounting hardware 64.

Figure 13:
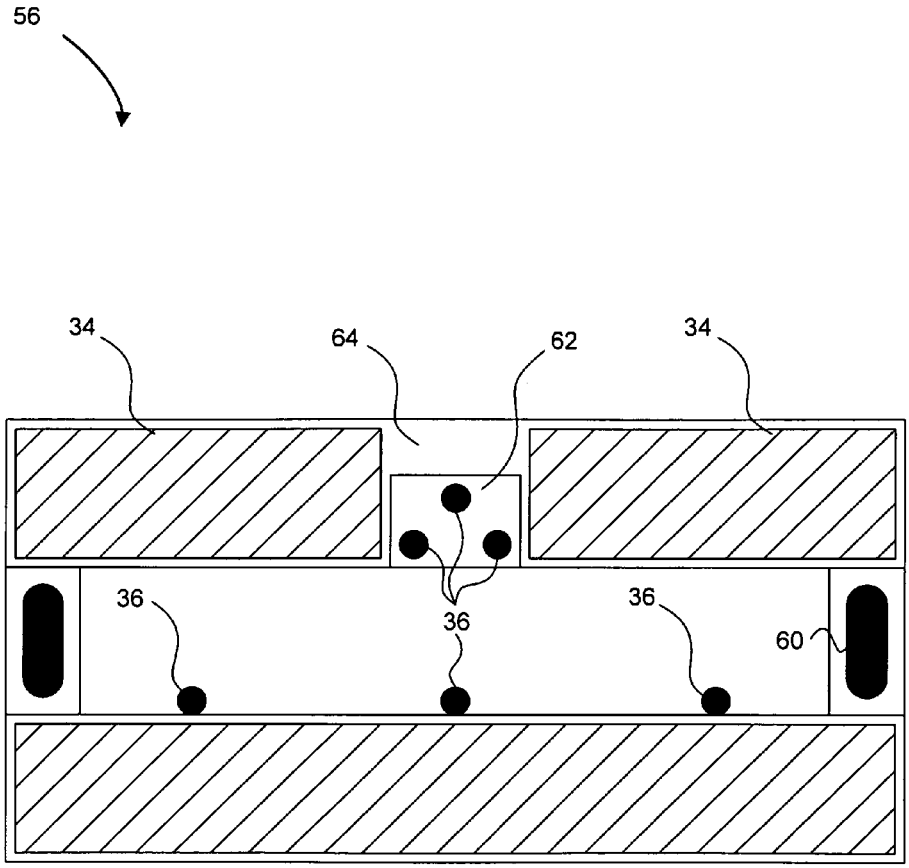
FIG. 13 is a schematic diagram illustrating a top cut-away view of another embodiment of a lighting apparatus.

FIG. 13 is a schematic diagram illustrating a top cut-away view of another embodiment of a lighting apparatus. The depicted lighting apparatus 56 includes a lens 62 to cover the LEDs 36. Additionally, the lens 62 may be configured to alter the light distribution pattern or diffuse the reflected glare from the light sources 36.

Although the LEDs 36 are shown grouped together, in one embodiment, other embodiments may implement separated LEDs 36 or a strip of LEDs 36. Moreover, the lighting apparatus 56 may include more than three light sources 36 on each side (to light up corresponding sides of a sign 24), or may be configured to light up a single side of a sign 24. Additionally, the depicted lighting apparatus 56 may have one or more removable covers (not shown) or access doors to access the internal compartment 68 of the housing 64.

Figure 14:
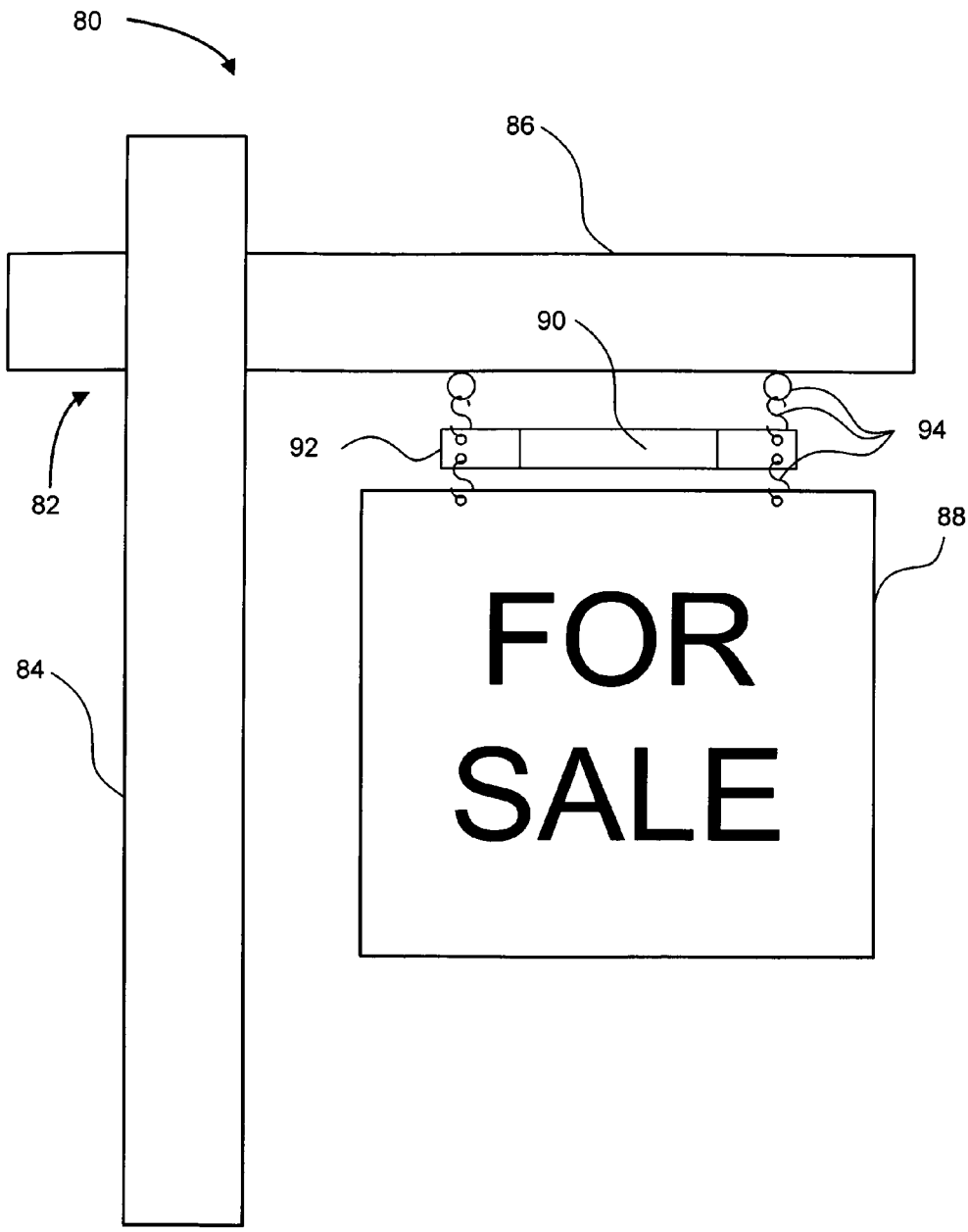
FIG. 14 is a schematic diagram illustrating another embodiment of a lighting system.

FIG. 14 is a schematic diagram illustrating another embodiment of a lighting system 80. Aspects of the depicted lighting system 80 may be substantially similar to the lighting system 10 of FIG. 1. In one embodiment, the lighting system 80 includes a sign post 82 with a vertical member 84 and a crossarm 86. A sign 88 is mounted to hang from (or otherwise attach to) the sign post 82 by mounting hardware 94 such as rings, hooks, wires, zip-ties, or other mounting hardware. The lighting system 80 also includes a light 90. IN one embodiment, the light 90 is a solar lighting apparatus. Alternatively, the light 90 may be a battery-powered, non-solar lighting apparatus. In some embodiments, the light 90 may attach to the mounting hardware 94 (or sign post 82 or sign 88) by a rail 92 coupled to the light 90.

Figure 15:
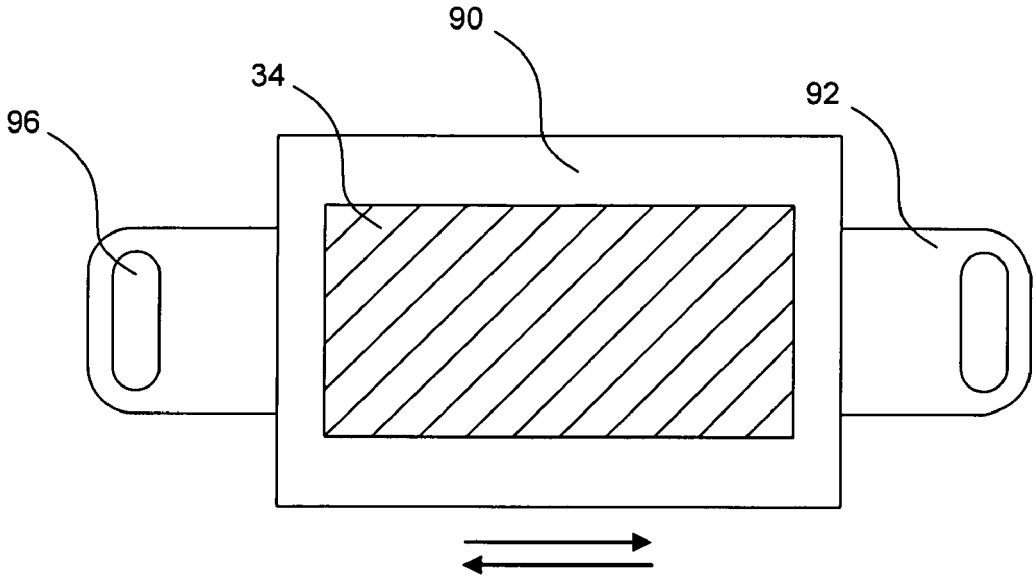
FIG. 15 is a schematic diagram illustrating another embodiment of a lighting apparatus having a mounting rail.

FIG. 15 is a schematic diagram illustrating another embodiment of a lighting apparatus 96 having a mounting rail 92. The mounting rail 92 may be a piece of plastic, wood, metal, or other relatively rigid material. The mounting rail 92 includes mounting device holes 96 to accept one or more types of mounting devices 94. Mounting rails 92 may be available in several lengths, or may be variable in length, to accommodate different mounting widths or assemblies.

Figure 16:
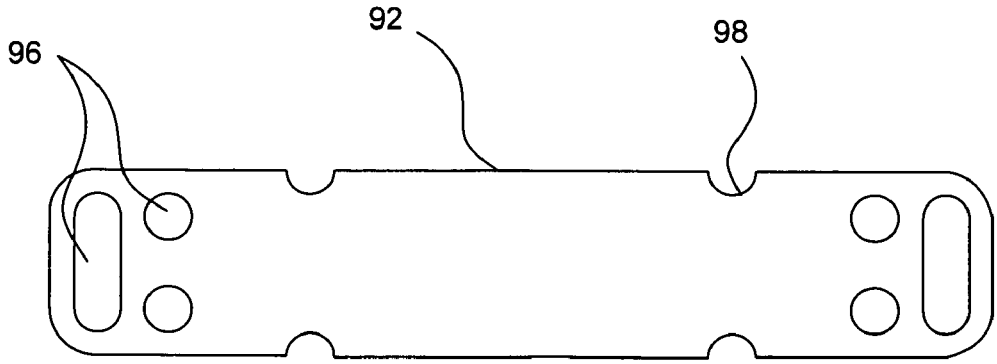
FIG. 16 is a schematic diagram illustrating one embodiment of a mounting rail.

FIG. 16 is a schematic diagram illustrating one embodiment of a mounting rail 92. The depicted embodiment includes several mounting holes 96, as well as one or more notches 98. In one embodiment, the notches 98 engage with corresponding protrusions 104 (see FIG. 17) of the lighting apparatus to maintain the lighting apparatus in a relatively fixed position and orientation. In embodiments without the notches 98 and protrusions 104, the lighting apparatus may freely slide back and forth along the length of the mounting rail 92.

Figure 17:
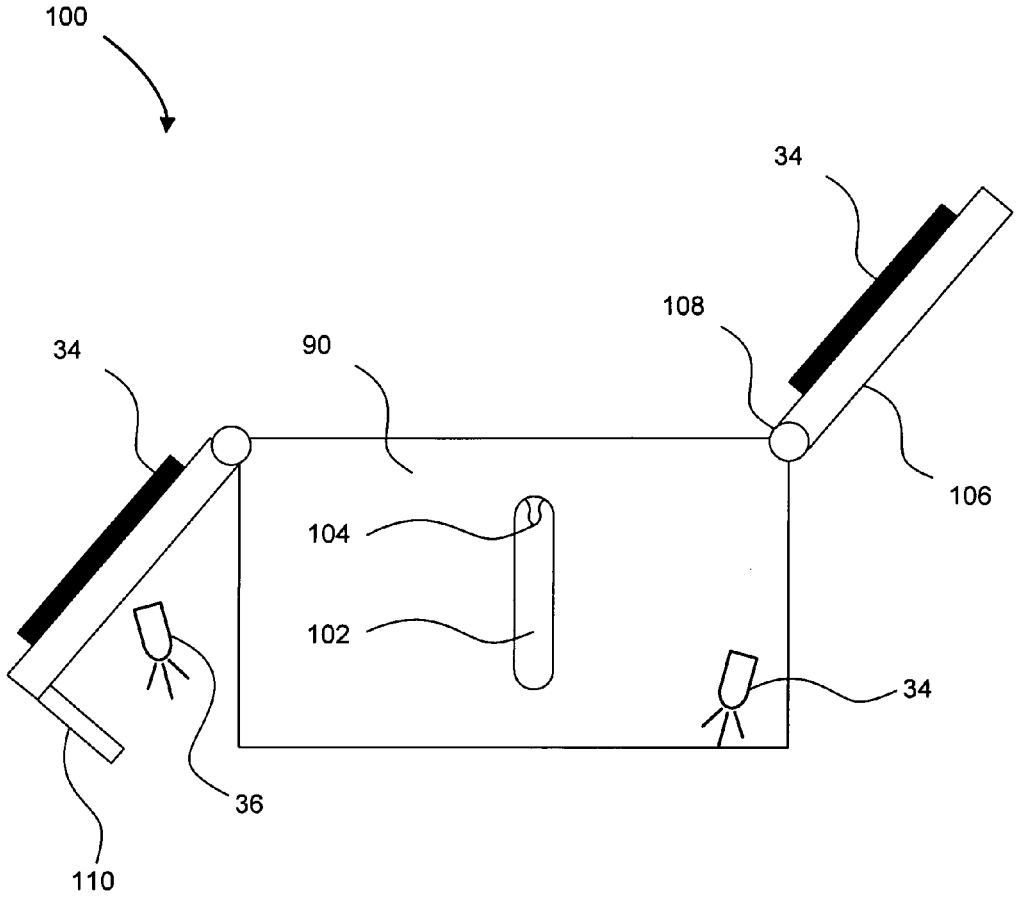
FIG. 17 is a schematic diagram illustrating another embodiment of a lighting apparatus having hinged solar panel mounting arms.

FIG. 17 is a schematic diagram illustrating another embodiment of a lighting apparatus 100 having hinged solar panel mounting arms 106. The mounting arms 106 are coupled to the housing by corresponding hinges 108. In one embodiment, the hinges 108 are configured to maintain the mounting arms 106 in a relatively fixed position. Light sources 36 may be mounted on the interior of the housing, or may be mounted on the mounting arms 106 (e.g., with a flange 110 to protect and hide the light source from view). The lighting apparatus 100 also includes a channel 102 through which a mounting rail 92 may be engaged. As described above, the lighting apparatus 100 may include one or more protrusions 104 to engage the notches 98 of the mounting rail 92.

Figure 18:
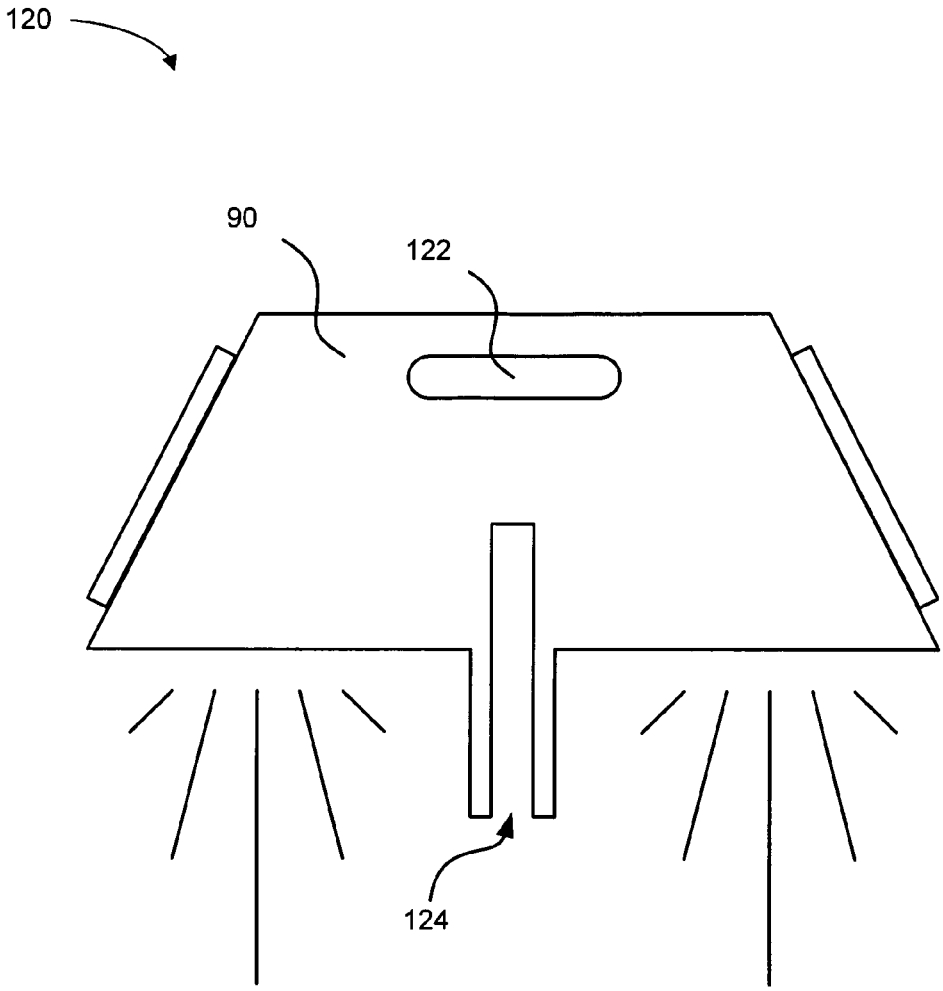
FIG. 18 is a schematic diagram illustrating another embodiment of a lighting apparatus having a mounting channel for mounting the lighting apparatus directly on a sign.

FIG. 18 is a schematic diagram illustrating another embodiment of a lighting apparatus 120 having a mounting channel 124 for mounting the lighting apparatus 120 directly on a sign 24. In one embodiment, the mounting channel 124 is configured to be about the same width as the sign 24. Alternatively, the mounting channel 124 may have a width approximately equal to, for example, a sign frame such as the sign frames shown in FIGS. 8-11.

The depicted lighting apparatus 120 also includes a horizontal mounting channel 122 which may be used to mount the lighting apparatus 120 on a horizontal mounting rail 92. Other orientations or combinations may be implemented in other embodiments.

Figure 19:
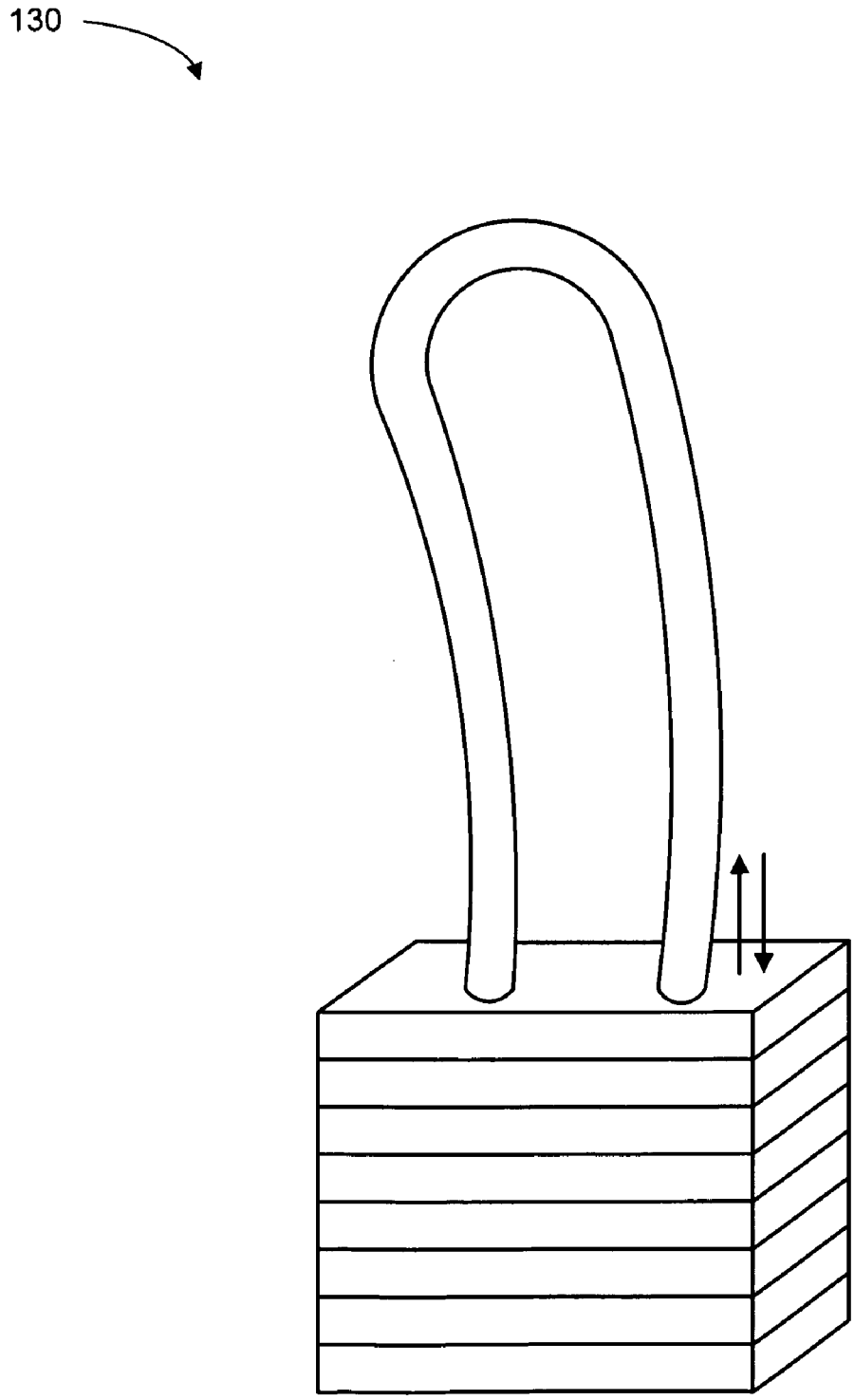
FIG. 19 is a schematic diagram illustrating one embodiment of a cable lock for use as a locking mechanism for a lighting apparatus.

FIG. 19 is a schematic diagram illustrating one embodiment of a cable lock 130 for use as a locking mechanism for a lighting apparatus. Cable locks are well known and not described in further detail herein. However, the cable lock 130 may be of long or short lengths, depending on how the cable lock might be used to lock the lighting apparatus to the sign post and or sign.

Figure 20:
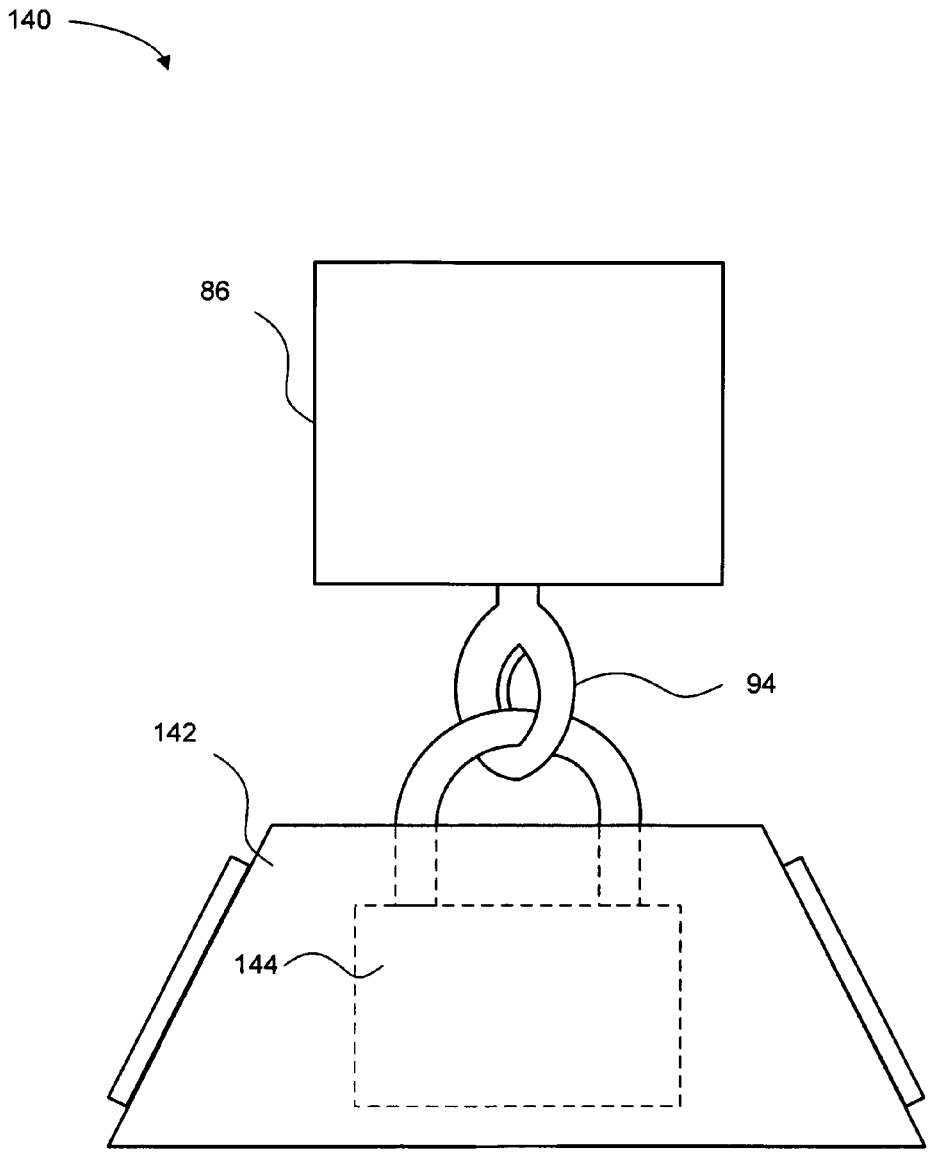
FIG. 20 is a schematic diagram illustrating another embodiment of a lighting system using a padlock or other locking mechanism.

FIG. 20 is a schematic diagram illustrating another embodiment of a lighting system 140 using a padlock 144 or other locking mechanism. The lighting apparatus 142 may be a solar lighting apparatus or a non-solar lighting apparatus. The use of a padlock such as a keyed padlock may facilitate securing the lighting apparatus 142 to the sign post 15 (e.g., to the mounting hardware 94 of the sign post 15).

Figure 21:
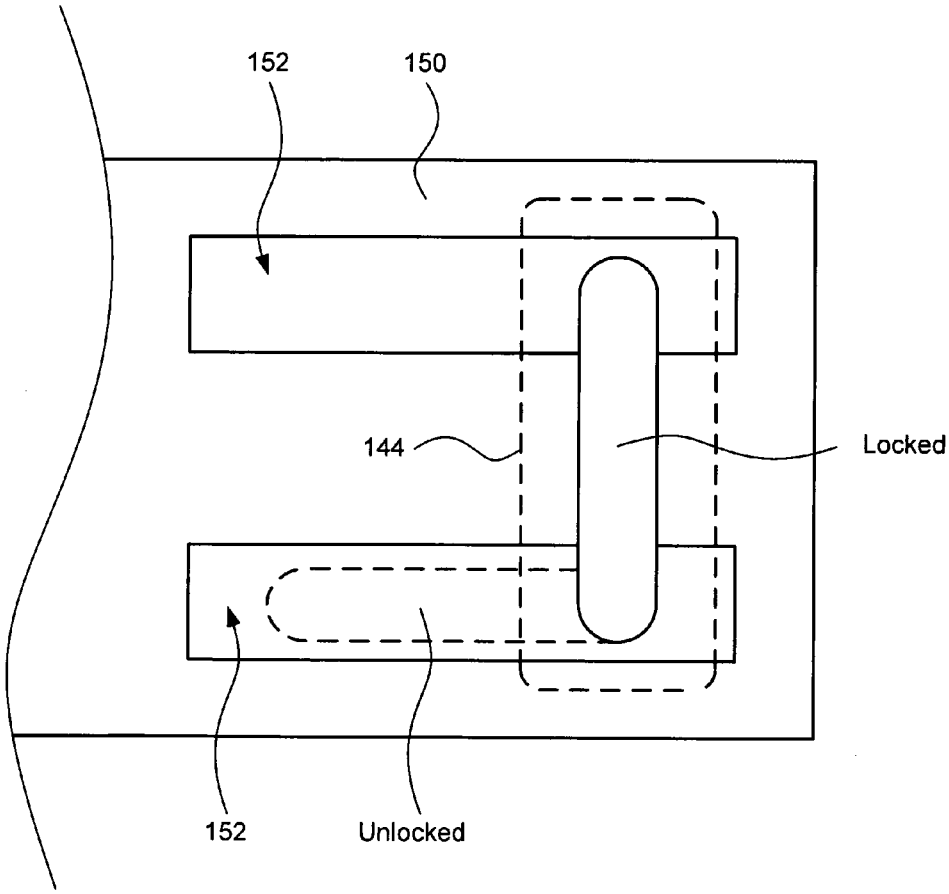
FIG. 21 is a schematic diagram illustrating a top view of a lighting apparatus with slide channels for adjustable mounting using a padlock or other locking mechanism.

FIG. 21 is a schematic diagram illustrating a top view of a lighting apparatus 150 with slide channels 152 for adjustable mounting using a padlock 144 or other locking mechanism. In one embodiment, the padlock 144 may be inserted through a single channel 152 and then arranged to close through the second channel 152, thus locking the lighting apparatus 150 (or mounting rail) to the sign post 15. In this way, the slide channels 152 allow the padlock 144 to be at a variable distance from the other mounting device (e.g., another padlock 144 or mounting ring) at the opposite end of the lighting apparatus 150. In one embodiment, a single padlock 144 or other locking device may be used. In another embodiment, two or more padlocks 144 may be used, thus preventing or discouraging someone from removing the lighting apparatus 150 from the sign post 15. In one embodiment, slide channels 152 may be provided at each location where a padlock 144 may be mounted to allow for significant flexibility in mounting the lighting apparatus 150 to sign posts 15 and mounting hardware having different mounting widths.

Figure 22:
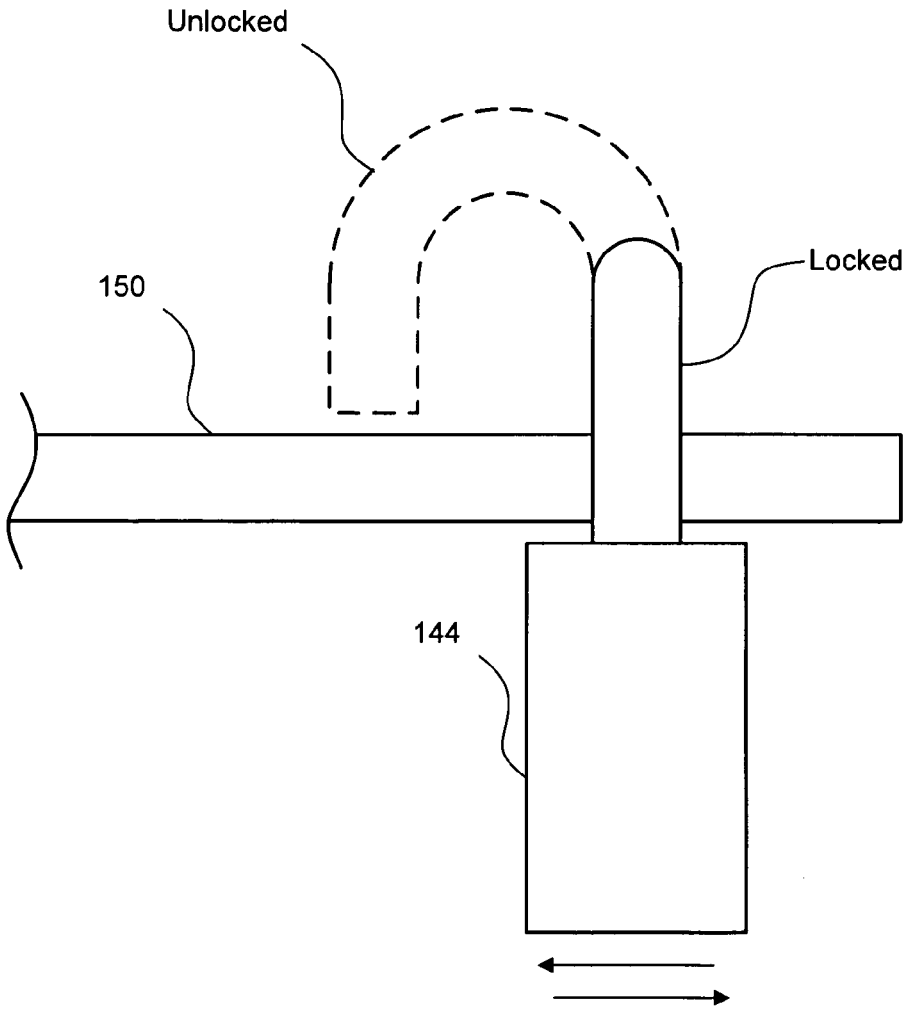
FIG. 22 is a schematic diagram illustrating a side cut-away view of the lighting apparatus and slide channels of FIG. 21.
Figure 23:
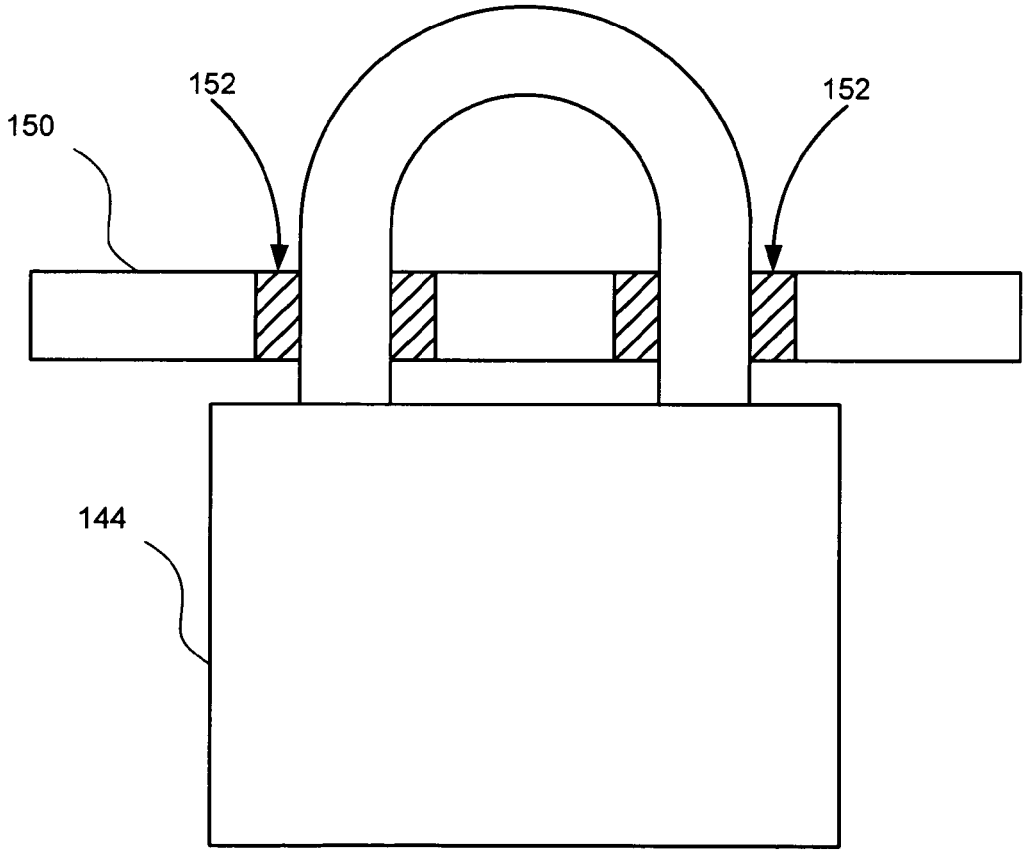
FIG. 23 is a schematic diagram illustrating another side cut-away view of the lighting apparatus and slide channels of FIG. 21.

FIG. 22 is a schematic diagram illustrating a side cut-away view of the lighting apparatus 150 and slide channels 152 of FIG. 21. FIG. 23 is a schematic diagram illustrating another side cut-away view of the lighting apparatus 150 and slide channels 152 of FIG. 21.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a housing to suspend directly below a bottom surface of a crossarm of a sign post so that the housing is completely below the crossarm of the sign post in a mounted position, the housing comprising an internal compartment and a top surface, wherein the top surface of the housing is below the crossarm of the sign post in the mounted position;

wherein the housing comprises a pair of adjacent slide channels in the top surface of the housing to accommodate light mounting hardware to movably couple the housing to the crossarm of the signpost, wherein each slide channel comprises a substantially linear channel opening through the top surface of the housing;

a light source within the internal compartment of the housing; and sign mounting hardware directly coupled to the housing to provide a mounting location for a sign to hang below the housing, directly from the sign mounting hardware, so that the housing is between the bottom surface of the crossarm of the sign post (which is above the housing) and the sign (which is below the housing) in the mounted position.

2. The apparatus of claim 1, wherein the light mounting hardware comprises a padlock having a shackle configured to be inserted through a first slide channel of the pair of slide channels, through a lighting mounting ring coupled to the bottom surface of the crossarm of the sign post, and through a second slide channel of the pair of slide channels to lock the housing to the crossarm of the sign post.

3. The apparatus of claim 1, wherein the housing comprises a mounting hole to accommodate a fastener to couple the housing directly to the crossarm of the sign post.

4. The apparatus of claim 1, further comprising a solar panel coupled to an exterior surface of the housing.

5. The apparatus of claim 1, wherein the housing comprises a battery compartment to house at least one battery, wherein the battery compartment is electrically coupled to the light source.

6. The apparatus of claim 1, further comprising a lens coupled to the housing to protect the light source from environmental conditions.

7. The apparatus of claim 6, wherein the lens comprises a light distribution pattern to produce a light distribution pattern to illuminate the sign.

8. The apparatus of claim 1, wherein the light source comprises a plurality of light emitting diodes (LEDs).

9. The apparatus of claim 1, further comprising a mounting arm coupled to the housing, wherein the mounting arm is movable with respect to the housing.

10. A system, comprising:

a sign post having a crossarm, wherein the crossarm comprises a bottom surface;

light mounting hardware coupled to the bottom surface of the crossarm; and a lighting apparatus coupled to the light mounting hardware to hang the lighting apparatus from the mounting hardware so that the housing is completely below the crossarm of the sign post in a mounted position, wherein the lighting apparatus comprises sign mounting hardware to hang a sign below the lighting apparatus, so that the lighting apparatus is completely between the bottom surface of the crossarm of the sign post (which is above the lighting apparatus) and the sign (which is below the lighting apparatus);

wherein the lighting apparatus comprises a housing with a pair of adjacent slide channels in a top surface of the housing, wherein each slide channel comprises a substantially linear channel opening through the top surface of the housing.

11. The system of claim 10, further comprising a locking mechanism to lock the lighting apparatus to the mounting hardware coupled to the crossarm of the sign post.

12. The system of claim 11, wherein the adjacent slide channels movably accommodate the locking mechanism.

13. The system of claim 10, wherein the lighting apparatus comprises a light source to illuminate the sign.

14. The system of claim 13, wherein the light source comprises a plurality of light emitting diodes (LEDs) to illuminate two sides of the sign.

15. The system of claim 13, wherein the lighting apparatus further comprises a battery coupled to the light source, and a solar panel coupled to the battery.

16. The system of claim 15, wherein the lighting apparatus further comprises control circuitry to control operation of the light source.

17. A system, comprising:

means for movably mounting a lighting apparatus to suspend completely below a bottom surface of a crossarm of a sign post to allow relative movement between the lighting apparatus and the crossarm of the sign post;

means for movably mounting a sign to suspend below the lighting apparatus to allow relative movement between the sign and the lighting apparatus, so that sign is indirectly coupled to the bottom surface of the crossarm with the lighting apparatus completely between the bottom surface of the crossarm of the sign post (which is above the lighting apparatus) and the sign (which is below the lighting apparatus);

means for defining a pair of adjacent slide channels in a top surface of the lighting apparatus, wherein each slide channel comprises a substantially linear channel opening in the top surface of the lighting apparatus; and means for generating light from electrical energy to at least partially illuminate the sign.

18. The system of claim 17, wherein the means for generating the light from the electrical energy comprises:

means for generating the electrical energy from solar energy; and means for storing the electrical energy.

19. The system of claim 17, further comprising means for accommodating a locking mechanism to lock the lighting apparatus to the crossarm of the sign post, wherein the means for accommodating the locking mechanism allow flexibility in mounting the lighting apparatus to the crossarm at various mounting widths.

* * * * *